US009457997B2

(12) United States Patent
Dorzbach et al.

(10) Patent No.: US 9,457,997 B2
(45) Date of Patent: Oct. 4, 2016

(54) COUNTERWEIGHT FIXING DEVICE

(71) Applicant: WOLFFKRAN HOLDING AG, Zug (CH)

(72) Inventors: Ulrich Dorzbach, Heilbronn (DE); Johannes Kleinknecht, Sachsenheim-Hohenhaslach (DE); Jochen Ziegler, Ilsfeld (DE)

(73) Assignee: Wolffkran Holding AG, Zug (CH)

( * ) Notice: Subject to any disclaimer, the term of this patent is extended or adjusted under 35 U.S.C. 154(b) by 77 days.

(21) Appl. No.: 14/359,185

(22) PCT Filed: Nov. 20, 2012

(86) PCT No.: PCT/EP2012/004800
§ 371 (c)(1),
(2) Date: May 19, 2014

(87) PCT Pub. No.: WO2013/075816
PCT Pub. Date: May 30, 2013

(65) Prior Publication Data

US 2014/0299563 A1 Oct. 9, 2014

(30) Foreign Application Priority Data

Nov. 21, 2011 (DE) ..... 10 2011 118 926

(51) Int. Cl.
*B66C 23/74* (2006.01)

(52) U.S. Cl.
CPC ..... *B66C 23/74* (2013.01)

(58) Field of Classification Search
USPC ..... 212/196
See application file for complete search history.

(56) References Cited

U.S. PATENT DOCUMENTS

| | | | | |
|---|---|---|---|---|
| 3,768,665 | A * | 10/1973 | Eiler | B66C 13/54 180/324 |
| 3,851,767 | A * | 12/1974 | Durand | B66C 9/14 212/196 |
| 5,799,806 | A * | 9/1998 | Cullity | B66F 11/044 212/195 |
| 5,833,268 | A * | 11/1998 | Aldrovandi | B60R 9/00 212/178 |
| 7,354,066 | B2 * | 4/2008 | Yamamoto | B62D 49/085 280/759 |
| 2005/0191049 | A1 * | 9/2005 | Chapman | B66F 11/048 396/428 |
| 2005/0191050 | A1 * | 9/2005 | Chapman | B60R 11/04 396/428 |

(Continued)

FOREIGN PATENT DOCUMENTS

| | | |
|---|---|---|
| DE | 17 81 137 A1 | 9/1970 |
| EP | 1 840 076 B1 | 1/2009 |

(Continued)

OTHER PUBLICATIONS

International Search Report issued in application No. PCT/EP2012/004800 on Feb. 15, 2013.

*Primary Examiner* — Emmanuel M Marcelo
(74) *Attorney, Agent, or Firm* — Foley & Lardner LLP

(57) ABSTRACT

Counterweight fixing device (1) for a crane, which is comparatively easy to install and can also be used in particular for cranes with a derricking jib, in which the derricking jib is rigidly connected to the mast (3), and at the same time provides a safe design without generating a high noise level during operation. The core principle of the design of the counterweight fixing device (1) is that the counterweight blocks (4) are simply suspended on a carrier bar (2), but the generation of noise is kept to a low level due to the suppression of the freedom of movement of the counterweight blocks (4).

12 Claims, 2 Drawing Sheets

(56) References Cited

U.S. PATENT DOCUMENTS

2006/0103125 A1* 5/2006 Yamamoto ..... B62D 49/085
280/760
2008/0053944 A1* 3/2008 Ramun ..... E02F 9/18
212/195
2013/0013251 A1* 1/2013 Schoonmaker ..... B66C 13/46
702/152
2013/0270209 A1* 10/2013 Stuehrwoldt ..... B66C 23/76
212/196
2013/0335271 A1* 12/2013 Lim ..... G01S 19/14
342/386

FOREIGN PATENT DOCUMENTS

FR 1 327 410 A 5/1963
JP 10 167674 A 6/1998

* cited by examiner

COUNTERWEIGHT FIXING DEVICE

The invention relates to a counterweight fixing means for a crane with a counter jib, in particular for a slewing tower crane with luffing jib, comprising a carrier bar, a connection of the carrier bar to the counter jib, and counterweight blocks that can be hooked onto the carrier bar, and plug-in pins.

For cranes, various options for the attachment of counterweights to the counter jib are known, for example the placing of the counterweights onto the counter jib, the laying of the counterweights into a basket on the counter jib, or the hooking of the counterweights onto the counter jib. Said counterweight attachment variants have the disadvantage that they demand either particularly precise work during the mounting process and/or give rise to a not inconsiderable noise nuisance during operation.

In particular, the most commonly used counterweight apparatus variant, the laying of counterweights into a basket, generally generates disturbing noises owing to a movement of the counterweights back and forth in the basket. This method is particularly unsuitable for slewing tower cranes with a luffing jib. Since, during an upward pivoting movement of the load jib, the counter jib connected to the load jib is lowered and, in the process, changes its angle with respect to the tower, the counterweights, which are normally not tailored in a precisely fitting manner to the basket, slide around in the basket. If the basket is not closed off at its top side, there is furthermore the risk of counterweights sliding or tipping out of the basket in the case of short outreach configurations.

The conventional methods for the hooking of counterweights onto counter jibs are also disadvantageous in particular in the case of luffing cranes. In one known approach for equipping the counter jib with counterweights, it is provided that, in disk-shaped counterweight blocks, which are normally cast from concrete, in each case one recess in the form of a bore is formed on the two narrow sides situated parallel to the longitudinal axis, into which recesses there is plugged in each case one plug-in pin. The plug-in pins are designed, in relation to the bores, such that a part of the plug-in pins protrudes out of the counterweight blocks after the plugging-in process. Said protruding part of the plug-in pins serves for hooking onto the counter jib. In the case of this known counterweight fixing means, notches are provided on the counter jib in each case for the hooking of the counterweight blocks onto the two longitudinal beams, which notches predefine the position of the counterweight blocks. The protruding parts of the two plug-in pins of a counterweight block are placed in each case into two notches which are situated opposite one another on the two longitudinal beams. This demands high precision during the mounting process. Furthermore, it is normally the case that no further fixing of the hooking-on arrangements is provided, such that this system, too, does not offer adequate safety for slewing cranes, because the plug-in pins can slide out of the notches during the raising of the jib and the associated lowering of the counter jib. Even securing the plug-in pins in the notches by means of an additional rail, which would require further effort during the mounting process, would not yield a counterweight fixing system that would also be satisfactory for slewing cranes. In the case of said conventional systems, it is specifically the case that the counterweights have a degree of play in the direction of the longitudinal axis of the counter jib in order that the demands for precision during the mounting process are not increased yet further in the case of a full set of counterweights being fitted, or in particular if only a partial set of counterweights is loaded. This has the effect that, in the event of a change in angle of the counter jib with respect to the tower of the crane, the plug-in pins that are mounted in the notches of the carrier of the counter jib, and thus also the counterweight blocks, perform a partial rotation. The tipping-over of said counterweight blocks, and in particular also the abutment of said counterweight blocks against one another that sometimes occurs, generate disturbing noises to the point of being a noise nuisance.

A particular disadvantage of said known counterweight fixing is that the elements composed of counterweight blocks and plug-in pins must in each case be precisely adapted in terms of their dimensions to the individual crane model in order to fit into the hooking-in openings on the counter jib but secondly lie adequately, by way of the plug-in pins, on the longitudinal beams of the counter jib.

The invention is therefore based on the object of providing a counterweight fixing means which does not have the above-mentioned disadvantages, that is to say a counterweight fixing means which permits easy mounting and which can be used with different crane types, in particular also in the case of luffing cranes.

The object is achieved by means of a counterweight fixing means for a crane, which has a counter jib, in particular for a slewing tower crane with luffing jib, comprising a carrier bar, a connection of the carrier bar to the counter jib, and one or more counterweight blocks that can be hooked onto the carrier bar, and one or more plug-in pins, in the case of which counterweight fixing means the carrier bar is arranged substantially at right angles to the longitudinal axis of the counter jib and horizontally, and the connection of the carrier bar to the counter jib comprises two connecting struts which are arranged at right angles to the carrier bar and which lie parallel to one another, and the counterweight fixing means comprises a transverse rail which is arranged parallel to the carrier bar, wherein the transverse rail has recesses for receiving plug-in pins, and the counterweights have substantially a U-shaped cross section, wherein the aperture in the U-shape allows the counterweight blocks to be hooked onto the carrier bar, and wherein the counterweight blocks, on their narrow side which is directed toward the counter jib when the counterweight blocks are in the hooked-on state, have recesses for receiving the plug-in pins.

A "horizontal" arrangement of the carrier bar means that one end and the other end of the carrier bar are each at substantially the same distance from the ground.

DETAILED DESCRIPTION OF THE INVENTION

Further embodiments are defined in the subclaims, or are described below.

The carrier bar is preferably a round bar. It is then expediently the case that the shape of the apertures in the counterweight blocks, by way of which the counterweight blocks are hooked onto the round bar, are of rounded form at the closed end of the aperture. The counterweight blocks can be positioned particularly easily on a round bar, or else on any other desired carrier bar, if the aperture in the U-shape of the counterweight blocks, that is to say the aperture by way of which the counterweight blocks are hooked onto the carrier bar, has a larger diameter toward the open aperture than at the closed aperture end. It is particularly preferable here for the aperture to taper from the open aperture end toward the closed aperture end.

In the case of such a counterweight fixing means, the counterweight blocks may in particular be cast from concrete. The outlay for drilling recesses for the plug-in pins in blocks composed of concrete is relatively manageable. This also applies to the machining of the apertures into the counterweight blocks that are provided for hooking onto the carrier bar. The apertures for hooking on may be allowed for already during the casting of the blocks.

The counterweight fixing means according to the invention permits relatively generous tolerances in the design of the counterweight blocks. The aperture in the counterweight block for hooking onto the carrier bar does not need to be cut so as to exhibit exact fitting accuracy. The dimensions of the counterweight blocks, in particular with regard to the height and the width of the counterweight blocks on the broad side thereof, are variable, such that, aside from the variation of the number of counterweight blocks that are hooked on, it is additionally possible for the overall counterweight to be adjusted by way of the dimensions of the individual counterweight blocks. Relatively large tolerances are also possible with regard to the longitudinal axis of the bores for the plug-in pins. A plug-in pin does not need to completely fill a recess in a counterweight block, as long as said plug-in pin merely connects the counterweight blocks and the transverse rail in captive fashion. The bores for the plug-in pins extend into the counterweight blocks to a distance of for example between 100 and 200 mm.

The connection of the plug-in pins to the transverse rail preferably provides that the recesses are notches on the top side of the transverse rail. Here, according to the invention, the expression "transverse rail" should also be understood to mean constructions in which, on the transverse rail itself, there are also mounted further elements into which the recesses are formed. Such elements are for example separate rails which are short in relation to the transverse rail itself and which therefore only have the recesses for the hooking-in of the plug-in pin(s) of one or two counterweight blocks. By means of notches on the top side of the plug-in rail, including notches that are formed into elements that are mounted on the transverse rail, it is possible for counterweight blocks for which the plug-in pin has already been plugged into the recess to be hooked onto the carrier bar. The plug-in pin then rests, as in the case of conventional counterweight fixing means, on the top of a supporting element, the transverse rail, but is plugged by way of the other end into the counterweight block. For fixing and usability in the case of luffing cranes, it is then merely necessary for a fixing device, preferably a locking bar, to be provided over the notches with the plug-in pins resting therein.

A further preferred connection of the plug-in pins to the transverse rail is realized by virtue of the recesses for receiving the plug-in pins extending through the transverse rail. In this way, the plug-in pins can be pushed through the transverse rail in a simple manner. The fixing of the plug-in pins may be realized in any desired manner. A person skilled in the art, on the basis of his average capabilities, is immediately familiar with technical means for preventing the plug-in pins from sliding out of the recesses again.

It is preferable for the length of a plug-in pin to substantially correspond to the sum of the length of a recess for the plug-in pins in a counterweight and in the transverse rail.

It is also advantageous for the plug-in pins to each have a length which is greater than the length of the recesses for receiving the plug-in pins in one of the counterweight blocks, on the one hand, and in the transverse rail, on the other hand.

In the case of the counterweight fixing means according to the invention, the shape of the counterweight blocks is preferably selected such that the center of gravity of a counterweight block is, in relation to a division of the counterweight block by the aperture for hooking-on purposes, situated at the side of that leg of the U-shaped counterweight block which is situated closer to the counter jib than the other leg. In this way, the construction according to the invention is utilized optimally with regard to the force distribution. This is advantageous in particular if the recesses in the transverse rail are notches into which the plug-in pins that plug into the counterweight blocks are hooked, because in this way, even in the case of luffing cranes with a rigid connection between load jib and counter jib, the plug-in pin tends to press against the transverse rail, and not against the fixing device, during a raising of the load jib and the associated lowering of the counter jib. The transverse rail prevents the counterweight blocks from rotating in the direction of the counter jib about the axis formed by the carrier bar. In this way, the counterweight blocks rest on the carrier bar virtually without movement even if the angle of the counter jib relative to the tower of the crane deviates significantly from the plane parallel to the ground, in which plane the counter jib and load jib are situated when in the horizontal position.

A particularly simple, material-saving and thus preferred embodiment of the counterweight fixing means according to the invention is obtained if the connecting struts are each arranged with one of their ends on one end of the carrier bar. This embodiment is advantageous in particular if the transverse rail also has, at a maximum, the length of the carrier bar. In this way, a frame with a rectangular outline is obtained as a holder for the counterweight blocks.

It is advantageous in particular for the connecting struts to lie parallel to the longitudinal axis of the counter jib.

BRIEF DESCRIPTION OF THE DRAWINGS

The invention will be explained in more detail below on the basis of the following figure, in which:

FIG. 1 shows an embodiment of the counterweight fixing means (1) according to the invention, with two hooked-on counterweight blocks (4). The counterweight fixing means (1) comprises a round bar as a carrier bar (2). The U-shaped counterweight blocks (4) are hooked by way of their aperture (9) onto the round bar. The aperture (9) is formed so as to be wider toward the open aperture end. The carrier bar (2) is connected via two connecting struts (6) to the transverse rail (7), which components altogether form a closed frame structure. The ends of the connecting struts (6) are directly connected to the ends of the carrier bar (2), such that no unnecessary and possibly even obstructive overhanging regions are provided in the frame structure. The frame structure is mounted directly on the counter jib (3).

In the embodiment shown, the counterweight blocks (4) are solid elements machined from a single piece, said elements being shaped such that their center of gravity lies in that leg (11*a*) of the counterweight block which is situated closer to the counter jib when the counter element is in the hooked-on state. Plug-in pins (5) are situated on that narrow side (10) of the counterweight blocks (4) which is oriented toward the counter jib (3) in the hooked-on state of the counterweight blocks (4) as shown in the present case. The transverse rail (7) fixes the counterweight blocks (4) in the hooked-on position that was adopted while the load jib and counter jib (3) were in the horizontal state. In the present case, the transverse rail (7) is also, within the meaning of the invention, considered to encompass short rails mounted on the transverse rail itself. Said short rails have notches as recesses (8*a*) such that, during the construction of the counterweight fixing means (1), the counterweight blocks (4) equipped with the plug-in pins (5) can be hooked onto the frame structure. A fixing device (12), in the present case a locking rod, encloses the plug-in pin (5) in the recess (8*a*), in the form of a notch, of the transverse rail (7), such that the counterweight block (4) cannot rotate about the round bar. FIG. 1 shows, for one counterweight block (4), the state during the hooking of the plug-in pin (5) into the transverse rail (7) with the counterweight block (4) resting on the round bar, without the plug-in pin (5) being fixed in the notch by the locking bar (12), and for the other counterweight block (4), the state with the plug-in pin (5) fixed, that is to say the operationally ready state.

FIG. 2 shows, in a cross section through a counterweight block (4) of the counterweight fixing means (1) as per FIG. 1, the different shaping of the legs (11*a*, 11*b*) of the counterweight block (4), said shaping being selected such that the center of gravity of the counterweight block (4) is situated on that side of the carrier bar (2) which is situated closer to the counter jib. It can also be seen in the cross section that the plug-in pin (5) is plugged into a recess (8*b*) in the counterweight block (4).

LIST OF REFERENCE SIGNS

Figure 1:
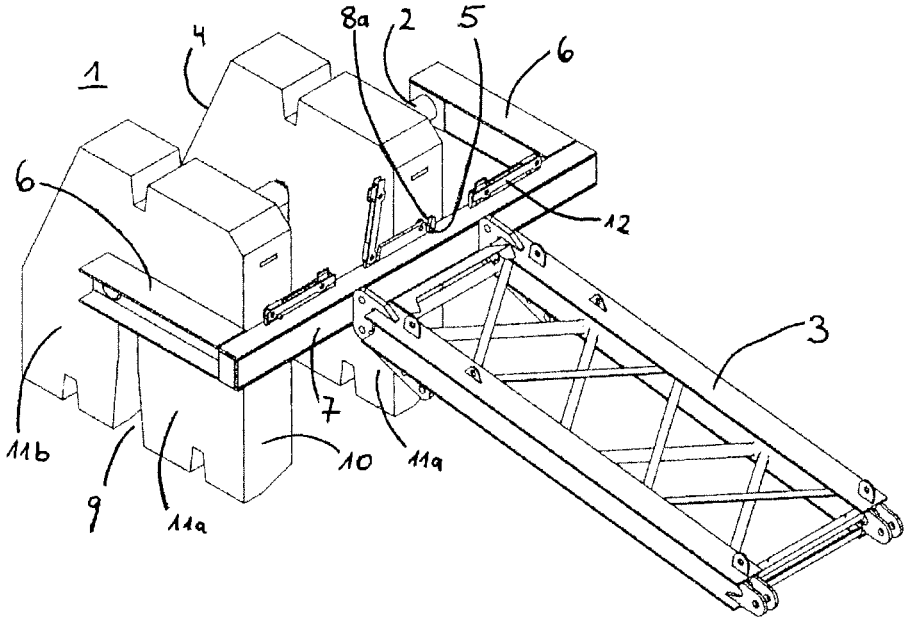
FIG. 1 shows a perspective view of an embodiment of the counterweight fixing means according to the invention, with hooked-on counterweight blocks.
Figure 2:
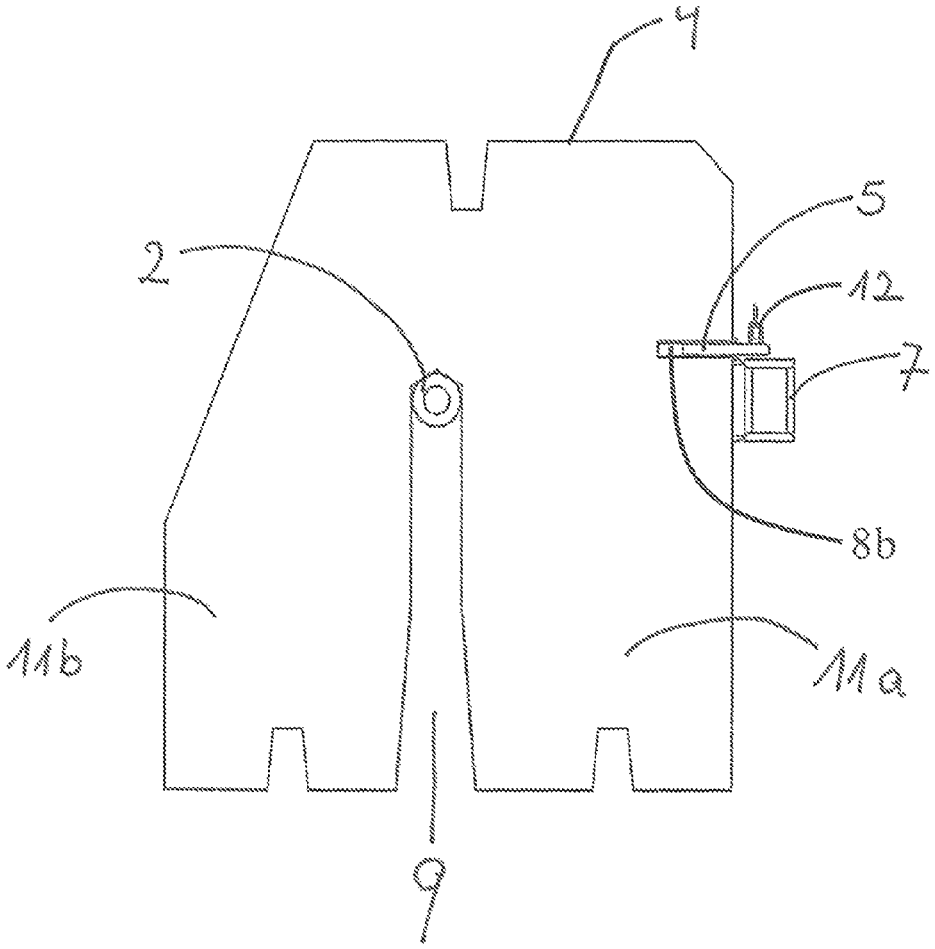
FIG. 2 shows a cross section, from a side elevation, through a counterweight block of the counterweight fixing means according to the invention as per FIG. 1, without counter jib.

1 Counterweight fixing means
2 Carrier bar
3 Counter jib
4 Counterweight block
5 Plug-in pin
6 Connecting struts
7 Counter rail
8*a* Recess (transverse rail)
8*b* Recess (counterweight block)
9 Aperture
10 Narrow side
11*a* Leg
11*b* Leg
12 Fixing device

We claim:

1. A counterweight fixing means for a crane having a counter jib, wherein the counterweight fixing means comprises a carrier bar, a connection of the carrier bar to the counter jib, and one or more counterweight blocks detachably hooked onto the carrier bar, and one or more plug-in pins, wherein a) the carrier bar is arranged substantially at right angles to the longitudinal axis of the counter jib and horizontally, b) the connection of the carrier bar to the counter jib comprises two connecting struts arranged at right angles to the carrier bar, wherein the connecting struts lie parallel to one another, c) the counterweight fixing means comprises a transverse rail which is arranged parallel to the carrier bar, wherein the transverse rail comprises recesses for receiving at least one or more of the plug-in pins, and d) the counterweight blocks have substantially a U-shaped cross section, wherein the aperture in the U-shape allows the counterweight blocks to be hooked onto the carrier bar, and wherein each counterweight block has a narrow side which is directed toward the counter jib when the counterweight blocks are in the hooked-on state, and wherein the narrow side has recesses for receiving the plug-in pins.

2. The counterweight fixing means as claimed in claim 1, wherein the connecting struts lie parallel to the longitudinal axis of the counter jib.

3. The counterweight fixing means as claimed in claim 2, wherein the carrier bar is a round bar.

4. The counterweight fixing means as claimed in claim 1, wherein the carrier bar is a round bar.

5. The counterweight fixing means as claimed in claim 1, wherein the counterweight blocks have in each case two legs, wherein the center of gravity of the counterweight blocks lies on the side of that leg which is situated closer to the counter jib than the other leg.

6. The counterweight fixing means as claimed in claim 1, wherein the aperture in the U-shape of the counterweight blocks has a larger diameter toward the open aperture end than at the closed aperture end, wherein the aperture preferably tapers from the open aperture end toward the closed aperture end.

7. The counterweight fixing means as claimed claim 1, wherein the connecting struts are each arranged with one of their ends on one end of the carrier bar.

8. The counterweight fixing means as claimed in claim 1, wherein the recesses for receiving the plug-in pins are notches on the top side of the transverse rail, into which notches one end, which is not plugged into a counterweight block, of each plug-in pin is laid, and wherein a fixing device is provided for fixing the plug-in pins in the notches.

9. The counterweight fixing means as claimed in claim 8, wherein the fixing device is a locking bar.

10. The counterweight fixing means as claimed in claim 1, wherein the recesses for receiving the plug-in pins extend in the transverse rail from one side of the transverse rail to the opposite side of the transverse rail, and the plug-in pins are fixed to the transverse rail.

11. The counterweight fixing means as claimed in claim 1, wherein the length of a plug-in pin substantially corresponds to the sum of the length of the recesses for each plug-in pin in the narrow side of the counterweight block and the length of the recesses in the transverse rail.

12. The counterweight fixing means as claimed in claim 1, wherein the crane is a slewing tower crane with lulling jib.

* * * * *